United States Patent [19]

Lane

[11] Patent Number: 4,764,268

[45] **Date of Patent: * Aug. 16, 1988**

[54] FLUID CATALYTIC CRACKING OF VACUUM GAS OIL WITH A REFRACTORY FLUID QUENCH

[75] Inventor: Philip A. Lane, Port Arthur, Tex.

[73] Assignee: Texaco Inc., White Plains, N.Y.

[ * ] Notice: The portion of the term of this patent subsequent to Nov. 25, 2003 has been disclaimed.

[21] Appl. No.: 43,076

[22] Filed: Apr. 27, 1987

[51] Int. Cl.[4] ..... C10G 11/18

[52] U.S. Cl. ..... 208/113; 208/48 Q; 208/160; 208/161

[58] Field of Search ..... 208/74, 75, 113, 77, 208/159, 160, 95, 153, 48 Q, 161

[56] References Cited

U.S. PATENT DOCUMENTS

| | | | |
|---|---|---|---|
| 2,908,630 | 10/1959 | Friedman | 208/74 |
| 3,193,494 | 7/1965 | Sanford et al. | 208/113 |
| 3,290,405 | 12/1966 | Rosenberg | 208/159 |
| 3,617,497 | 11/1969 | Bryson et al. | 208/120 |
| 3,847,793 | 11/1974 | Schwartz et al. | 208/70 |
| 3,856,659 | 12/1974 | Owen | 208/159 |
| 4,147,617 | 4/1979 | Nace | 208/95 |
| 4,218,306 | 8/1980 | Gross et al. | 208/120 |
| 4,419,221 | 12/1983 | Castagnos et al. | 208/155 |
| 4,422,925 | 12/1983 | Williams et al. | 208/75 |
| 4,624,771 | 11/1986 | Lane et al. | 208/74 |

*Primary Examiner*—Anthony McFarlane

*Attorney, Agent, or Firm*—Jack H. Park; Kenneth R. Priem; Richard A. Morgan

[57] ABSTRACT

Vacuum gas oil is catalytically cracked in the presence of a fluid zeolite catalyst in a riser reactor and then quenched before discharging into the disengaging section of a stripper vessel. The quench fluid is injected into the last 10 vol % of the riser reactor to prevent over cracking. In this manner, the amount of cracking which takes place in the disengaging vessel is reduced. The quench injection nozzles should be located at a point near the riser outlet but far enough from the outlet that the mixture in the riser and the quench fluid have come to temperature equilibrium by the time the mixture reaches the riser outlet. The quench fluid should be essentially inert to cracking, e.g. water or selected hydrocarbon fractions such as an intermediate cycle gas oil or heavy recycle naphtha.

11 Claims, 6 Drawing Sheets

DRY-GAS YIELD VS. CONVERSION (WT PCT FF)

PROPANE YIELD VS. CONVERSION (WT PCT FF)

PROPYLENE YIELD VS. CONVERSION (WT PCT FF)

TOTAL-DB-NAPHTHA YIELD VS. CONVERSION (VOL PCT FF)

LCGO YIELD VS. CONVERSION (VOL PCT FF)

HCGO YIELD VS. CONVERSION (VOL PCT FF)

TOTAL-DB-NAPHTHA
OCTANES VS. CONVERSION
MOTOR AND RESEARCH

LEGEND

| |
|---|
| ✱ - VGO AND NO QUENCH |
| □ - VGO WITH WATER QUENCH |
| FF-FRESH FEED |

FLUID CATALYTIC CRACKING OF VACUUM GAS OIL WITH A REFRACTORY FLUID QUENCH

CROSS-REFERENCE TO RELATED APPLICATION

This patent application is related to U.S. Pat. No. 4,624,771 issued Nov. 25, 1986 to Philip A. Lane et al.

BACKGROUND OF THE INVENTION

1. Field of the Invention

The invention relates to the fluidized catalytic cracking of vacuum gas oil. More particularly, the invention relates to cracking vacuum gas oil to produce a gasoline and lighter boiling fraction. This is accomplished by quenching the cracked vacuum gas oil with a refractory fluid to prevent over cracking.

2. Description of Other Related Methods in the Field

The cracking of a hydrocarbon by first injecting a clean gas oil, then dirtier gas oils at points along the reaction zone is shown in U.S. Pat. No. 2,908,630. This method of multiple injection was extended to the residual oil range in U.S. Pat. No. 3,193,494. In that patent a residual oil containing as much as 15 ppm by weight of nickel and 30 ppm by weight of vanadium was injected as the last component of a three component system. The first component was gas oil comprising 50–99% of the total feed and the second component was a heavier gas oil boiling from about 650°–950° F. The concentration of the residual oil was about one-tenth that of the first gas oil injected or 5–10% of the total feed. The use of diluents such as steam, nitrogen and hydrocarbons with boiling points less than about 430° F. to improve the gasoline selectivity is shown in U.S. Pat. Nos. 3,617,496 and 3,617,497. U.S. Pat. No. 3,617,497 discusses cracking a gas oil by injecting a low molecular weight portion of the gas oil to the bottom of a riser and a separate higher molecular weight portion of the gas oil to the upper portion of a riser. Two articles describe a downstream injection system: Bryson, M. C. and Huling, G. P., *Gulf Explores Riser Cracking,* Hydrocarbon Processing, May, 1972, and Campagna, R. J. and Krishna, A. S., *Advances in Resid Cracking Technology,* Katalistiks Fifth Fluid Catalytic Cracking Symposium, May 22–23, 1984. The first of these articles utilizes the teaching of U.S. Pat. No. 3,617,497 and deals with conversion from bed cracking to riser cracking. The second article discusses vacuum gas oil (VGO) cracking and the use of alternate injection points to shift the gasoline/distillate ratio. The article states that the method causes a decrease in gasoline octane.

BRIEF SUMMARY OF THE INVENTION

The present invention is an improvement in a fluidized catalyst cracking process for converting a vacuum gas oil fraction to a gasoline and lighter boiling fraction. In the improved process, a vacuum gas oil is contacted with regenerated fluidized cracking catalyst to form a first suspension in an initial portion of a riser conversion zone for a contacting time of 1.5 to 5.0 seconds at hydrocarbon conversion temperature at least 5° F. above the temperature of maximum debutanized naphtha conversion without a refractory fluid quench. In a downstream portion of the riser conversion zone, the first suspension is contacted and thereby quenched with a refractory fluid for a contacting time of 0.5 seconds or less at reduced temperature at least 10° F. below the temperature of maximum debutanized naphtha conversion. The vacuum gas oil fraction is cracked to hydrocarbon conversion products in the gasoline boiling range and lighter and carbonaceous contaminants are deposited on the catalyst. As a result of quenching, over cracking is reduced. Hydrocarbon conversion products are separated from the catalyst. Catalyst temperature is raised to about 1100° F. to 1400° F. by oxidation of the deposited carbonaceous contaminants in the catalyst regeneration zone. Contaminants on catalyst are reduced to 0.1 wt % or less based on carbon.

DETAILED DESCRIPTION OF THE DRAWINGS

Figure 1:
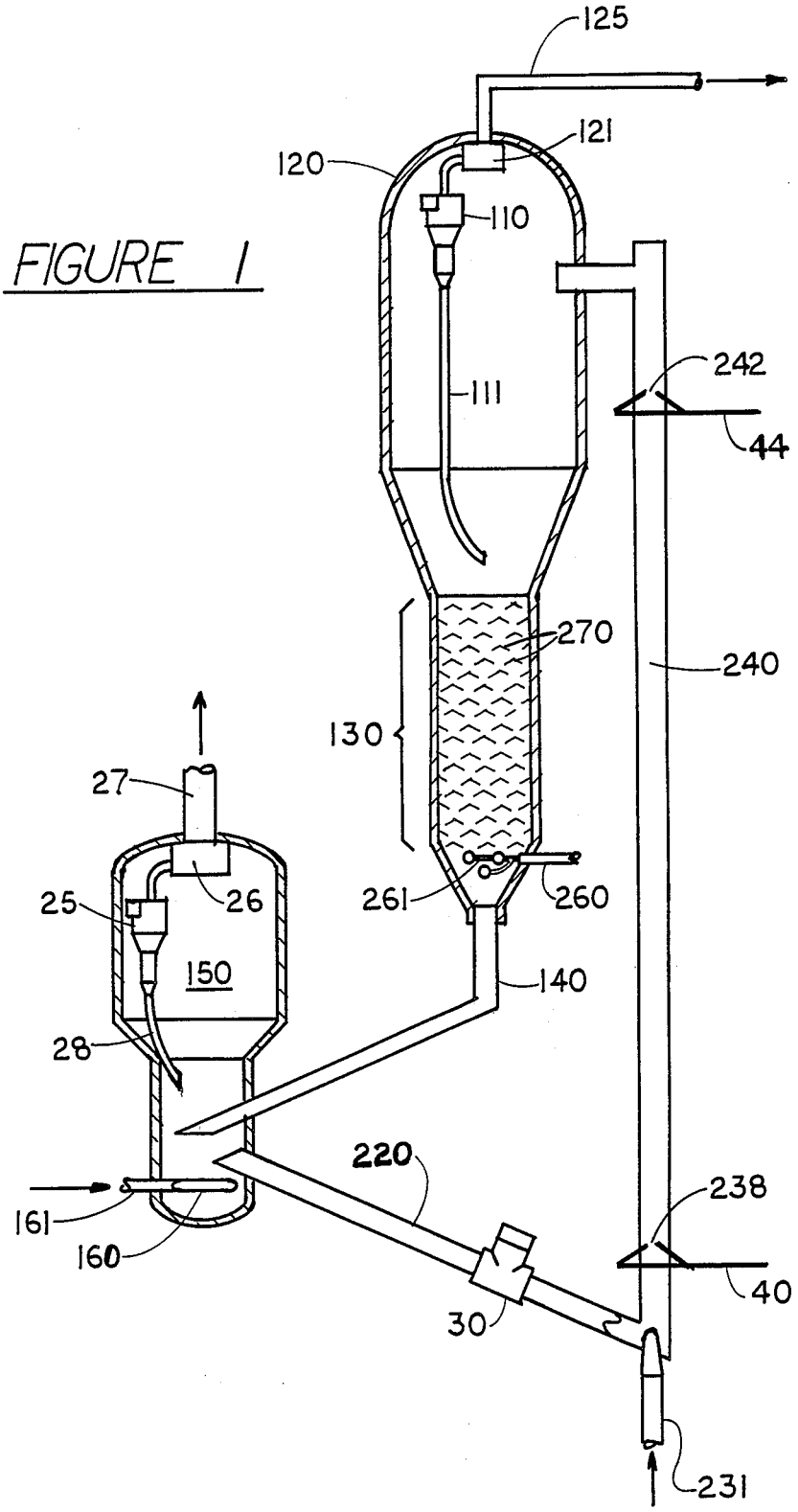
FIG. 1 is a diagramatic arrangement of a fluid catalytic cracking apparatus comprising a riser reactor, catalyst separator and regenerator.

An apparatus for carrying out the process of the invention is shown in FIG. 1. A clean, freshly regenerated catalyst is delivered by regenerated catalyst standpipe 220 into the initial or lower portion of riser reactor 240. The regenerated catalyst has a carbon content less than about 0.1 wt % and an ASTM microactivity of 55–80. As the catalyst enters the riser, its temperature is decreased by the addition of a fluidization medium delivered by line 231. The fluidization medium may be steam, nitrogen or low molecular weight hydrocarbons such as methane, ethane or ethylene. The amount of fluidization medium must be sufficient to fluidize the fluid zeolite catalyst in the base of riser 240 above the minimum fluidization velocity to move the catalyst toward lower injection point 238 for the hydrocarbon oil. Vacuum gas oil (VGO) having a boiling range of about 400°–1000° F. is heated and delivered to the injection point through conduit 40. The VGO enters the riser by way of a first injection nozzle (not shown) which may be a single nozzle or an arrangement of more than one nozzle which mixes oil and catalyst quickly and completely after injection. The amount of catalyst circulated must be enough to completely vaporize the oil and be sufficient to crack the oil to a slate of products containing gases, low boiling liquids and the desirable liquids of gasoline and light cycle gas oil. The mixture of products and unconverted gas oil vapor have sufficient velocity to transport the fluid catalyst through the riser 240 to the upper feed injection point 242 in a downstream portion of the riser 240. A refractory fluid is delivered to injection point 242 by way of conduit 44 and second injection nozzle (not shown).

The refractory fluid is essentially inert to cracking so that it quenches without significantly increasing the coke make. Liquid water or steam are good refractory fluids, with water preferred. Steam quality and pressure is not critical as long as it is greater than about 25 psig to get into the riser and low enough temperature to quench a 1000° F. to 1200° F. hydrocarbon vapor. If the refractory is hydrocarbon it must be essentially inert to cracking, so that it functions as a quench and does not chemically interact with cracking catalyst. For this purpose a fraction of the cracked hydrocarbon conversion products of riser reactor 240 is uniquely suited. The fraction has been cracked and therefore is essentially inert to additional cracking at the same conditions.

A number of refractory fluids may be utilized, including: recycle gas oils such as light cycle gas oil (430° F.–670° F.), heavy cycle gas oil (670° F.–1000° F.), and intermediate cycle gas oil (650° F.–800° F.) or recycle naphtha (115° F.–430° F.) preferably heavy naphtha (250° F.–430° F.). All of these fractions have been cracked and are essentially inert to further cracking and are refractory.

The refractory fluid is quickly and thoroughly mixed with the catalyst and oil vapors already present in the reaction zone. Injection of the refractory fluid at the upper injection point 242 cools the reaction zone reducing over cracking of the VGO. Quenching reduces the undesirable over reaction of the primary products from VGO cracking; gasoline and light cycle gas oil. By reducing over reaction, high yields of the primary products are preserved. The refractory fluid undergoes essentially no reaction to products and is essentially inert to cracking catalyst.

The mixture of catalyst and oil vapors proceed along riser 240 to separator 120. The riser conversion zone comprises the internal volume of the riser from the lower injection point 238 to the separator 120. The oil vapors are removed from the separator 120 through cyclones 110 and plenum 121 and are delivered through a conduit 125 to fractionation and purification means. Entrained catalyst is separated in cyclone 110 and falls to a lower portion of the separator 120 through dipleg 111. The dipleg is sealed by, for example, J-valves, trickle valves, flapper valves, etc.

The catalyst flows into the stripping zone 130 containing baffles 270 or other means to contact the catalyst and stripping medium. The stripping medium may be nitrogen, steam or other suitable material delivered by conduit 260 to distributor 261. Distributor 261 uniformly disperses the stripping medium into the stripping zone 130 and removes entrained hydrocarbons. The hydrocarbons stripped from the catalyst and stripping medium exit with the product vapors through cyclones 110.

The stripped catalyst leaves stripping zone 130 and is delivered to the regenerator 150 by way of standpipe 140. The catalyst is uniformly distributed into the regenerator to facilitate the removal of coke deposited on the catalyst in the reaction zone.

The regenerator 150 contains a dense phase bed of catalyst and a dilute phase of catalyst. Most of the coke is removed in the dense phase bed. A combustion medium of air or oxygen and nitrogen is delivered by conduit 161 to a distribution device 160 to mix combustion medium and coked catalyst. Coke is burned from the catalyst to give a flue gas containing amounts of $CO_2$, $SO_2$, $SO_3$ and $NO_X$. The combustion of the coke to $CO_2$ is preferably carried out at a regenerator temperature at least about 1100° F. to about 1400° F. in the presence of a combustion promoter such as platinum so that 0.1 wt % or less residual carbon is left on the catalyst. The flue gas passes through the regenerator dilute phase, cyclones 25, plenum 26 and flue gas line 27 for further processing. As the flue gas passes through the cyclones, catalyst is separated and returned to the dense bed by way of dipleg 28. The regenerated catalyst flows from the dense bed to standpipe 220. Slide valve 30 regulates the flow of regenerated catalyst from standpipe 220 to riser 240.

FIGS. 2–14 are discussed in the Example.

DETAILED DESCRIPTION OF THE PREFERRED EMBODIMENTS

This invention concerns the cracking of a vacuum gas oil fraction to gasoline and lighter products in the presence of a fluid cracking catalyst at temperatures in the range of 900° F. to 1100° F.

When hydrocarbon fractions are catalytically cracked, the most desirable products are debutanized (DB) gasoline with an end point of about 430° F. and light cycle gas oil boiling from about 430° F. to about 670° F. The desired octane of the debutanized gasoline is the maximum attainable without reducing the quantity of gasoline produced. When the temperature at which the hydrocarbon fractions are being catalytically cracked is increased, the conversion of the feed hydrocarbons to lighter boiling hydrocarbons is increased and the octane of the debutanized gasoline produced also increases. A temperature point is eventually reached where the gasoline produced in the primary reactions is cracked to lighter and less desirable hydrocarbon fractions in secondary reactions. The conversion temperature at which these secondary reactions begin to decrease the quantity of naphtha produced with increased conversion is termed the "peak point" and corresponds to the maximum conversion to DB naphtha. The peak point for vacuum gas oil ranges from 920° F. to 1050° F. depending on the source of the crude oil from which it is derived. When the riser outlet temperature is raised above the temperature corresponding to peak point conversion, secondary reactions increase. Most of these secondary reactions take place at the very end of the riser reaction zone and in the dilute phase of the disengaging vessel (separator 120).

A new method of cracking hydrocarbon fractions has been discovered wherein a quench fluid such as water, steam or a recycled cracked fraction is injected into the reaction zone in the last 5–15 vol % of the riser reactor. About the last 10 vol % is preferred. Quench fluid in an amount of about 1 to 20 wt % of the feed is sufficient to rapidly decrease the reaction temperature, preventing the less desirable secondary reactions from taking place. Optimum gasoline range product yield is obtained by maintaining the riser temperature immediately below the quench point at 925° F. to 1050° F., more preferably 950° F. to 1000° F., most preferably 5° to 15° F. above the peak point temperature for this location, and then quenching in the last 10 vol % of the riser so that the riser outlet temperature is reduced below that peak point temperature. At the preferred cracking temperature a reduction of 10° F. to 15° F. below the peak point temperature at the quench point produces beneficial results. The temperature reduction is accomplished, for example, with a water quench of about 3–7 wt % of the feed at a catalyst to oil ratio of 4 to 5. The optimum quantity of other quench fluids is determined by the heat of vaporization of the fluid and the catalyst to oil ratio of the reaction mixture.

Figure 2:
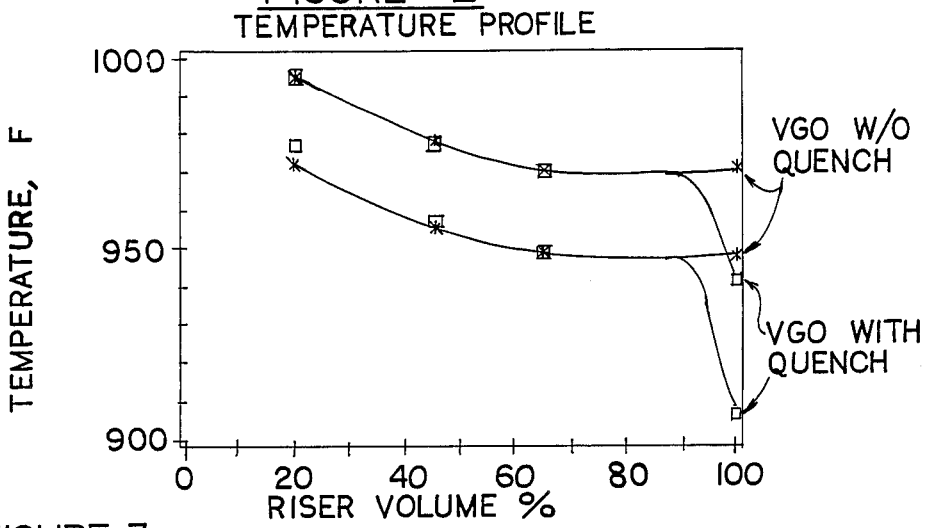
FIG. 2 is a graphical presentation of the riser temperature profile.

The effect of the catalyst to oil ratio on the quench is shown in FIG. 2. The higher temperature curve was run at a higher catalyst to oil ratio to generate the heat. The amount of quench was the same for both curves. The heat capacity of the additional catalyst diminished the effect of the quench on the oil in the higher catalyst to oil case.

This invention increases the octane and yield of the naphtha without an increase in the quantity of gaseous hydrocarbons. Another improvement is the effect of this quenching on the heat balance of the fluid catalytic cracking unit. Quenching the oil removes heat from the catalyst and thus lowers the temperature at which the regeneration of the catalyst takes place. This reduces catalyst degradation and extends the life of the catalyst.

In order to take full advantage of the downstream quench, the regenerator must be operated in a complete combustion mode. The flue gas leaving the regenerator should contain less than 0.5 vol % carbon monoxide and the regenerated catalyst must contain less than 0.1 wt % carbon.

The catalyst employed in the present invention comprises any of the fluidizable catalysts used for the cracking of gas oil. They are typically a large pore crystalline aluminosilicate customarily referred to as zeolite and an active metal oxide, as exemplified by silica-alumina gel or clay. The zeolites employed as cracking catalysts herein possess ordered rigid three-dimensional structures having uniform pore diameters within the range of from about 5 to about 15 Angstroms. The crystalline zeolitic catalysts employed herein comprise about 1 to b 25 wt % zeolite, about 10 to 50 wt % alumina and the remainder silica. Among the preferred zeolites are those known as X type zeolite and Y type zeolite wherein at least a substantial portion of the alkali metal ions from the original preparation have been replaced with such cations as hydrogen and/or metal or combinations of metals such as barium, calcium, magnesium, manganese or rare earth metals.

Metals contamination of the catalyst severely reduces the activity of the catalyst or substantially increases dry gas make. Therefore, equilibrium or fresh cracking catalyst should be flushed through the unit daily to maintain the desired activity and reduce the dry gas make. Dry gas production and activity loss is minimized by passivating metals using passivators used in the industry or by the use of higher than normal dispersion or fluidization steam rates.

The invention is distinguished from the prior art by the injection of the refractory fluid in the last 5 to 15 vol % of the riser. This process requires complete combustion of the coke to carbon dioxide with excess oxygen and less than 0.5 vol % carbon monoxide in the regenerator flue gas such that the regenerated catalyst carries less than 0.1 wt % carbon. Regenerator temperature should be maintained preferably above 1300° F. such that catalyst circulation and catalyst-to-oil ratio can be kept low. The riser temperature should be maintained at 920° F. to 1050° F., preferably 950° F. to 1000° F. most preferably 955° F. to 975° F. in the reaction zone before the refractory fluid is injected.

EXAMPLE

A series of test runs was conducted on a 5-BPD fluid catalytic cracking pilot unit using an equilibrium fluidized zeolite cracking catalyst with the properties shown in Table I. A fresh catalyst was added continuously during the runs to maintain the activity of the equilibrium catalyst. The experiments consisted of eight runs charging a nominal 600°-1000° F. vacuum gas oil to the equilibrium catalyst. In four runs the vacuum gas oil alone was charged. In four additional runs a water quench was injected. The properties of the vacuum gas oil are shown in Table II.

The unit was operated at the conditions shown in Table III which resulted in the product yields and qualities shown. In addition to those conditions shown in Table III, the following operating conditions were held constant throughout the test runs.

| | | |
|---|---|---|
| Reactor Pressure | 25 | psig |
| Regenerator Flue Gas $O_2$ | 3.5 | vol % |
| Carbon on Regenerated Catalyst | 0.1 | wt % |
| Fluidization Steam | 0.12 | lb moles/bbl fresh feed |
| Fluidization Nitrogen | 0.58 | lb moles/bbl fresh feed |

In Table III, Runs 1-2 and 5-6 are base data in which VGO was cracked to give a high yield of debutanized (DB) naphtha. Runs 3-4 and 7-8 were the results of quenching with liquid water at a point 90 vol % downstream from the feed injection point of the riser.

Figure 3:
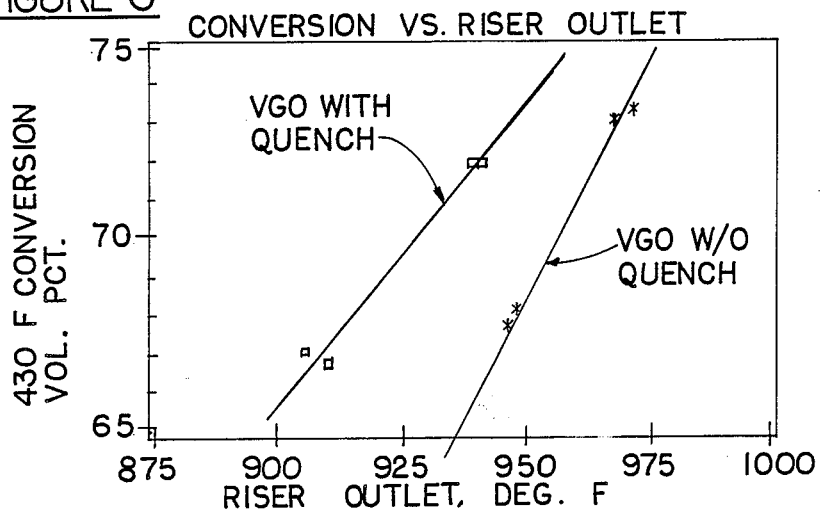
FIG. 3 is a graph of the relationship between riser outlet temperature and conversion.
Figure 4:
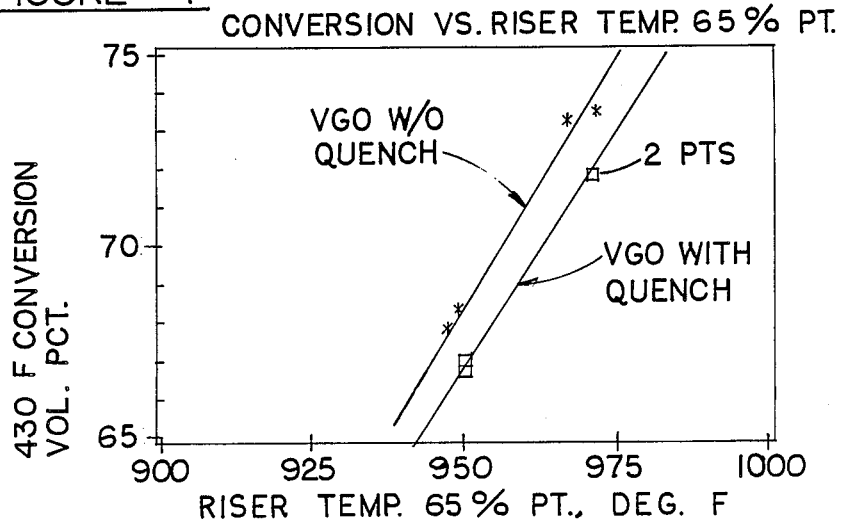
FIG. 4 is a graph of conversion related to a specified riser temperature control point.
Figure 5:
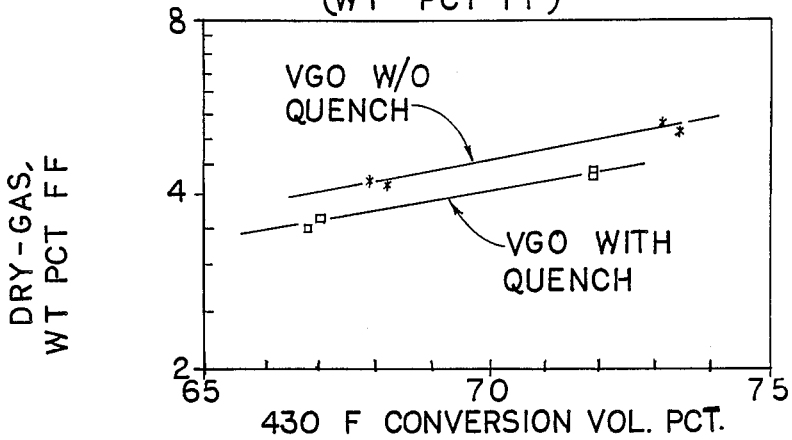
FIG. 5 is a graph of the dry gas yield from cracked vacuum gas oil at different conversions.
Figure 6:
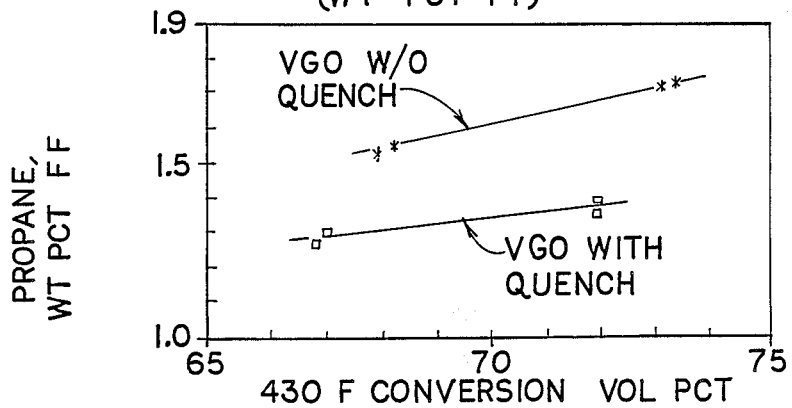
Figure 7:
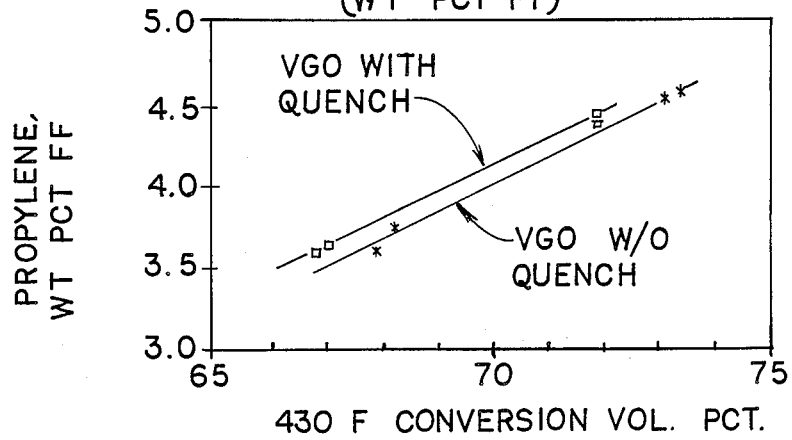
FIGS. 7–10 are graphs of the $C_3$–$C_4$ yields from cracked vacuum gas oil.
Figure 8:
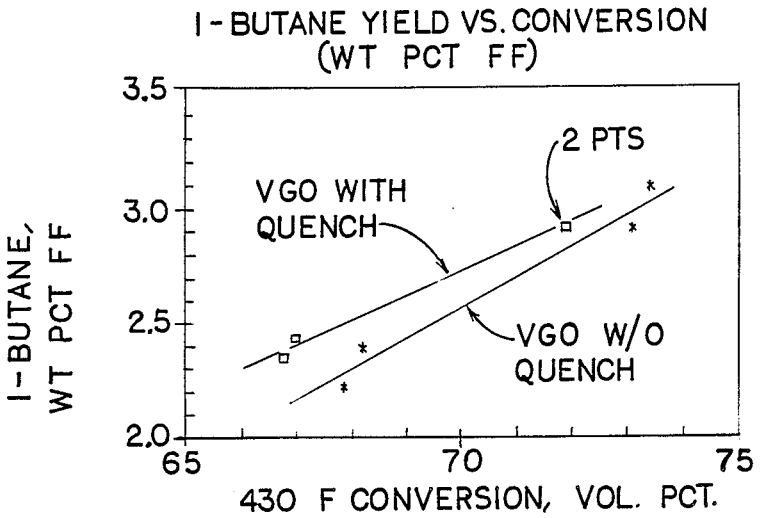
Figure 9:
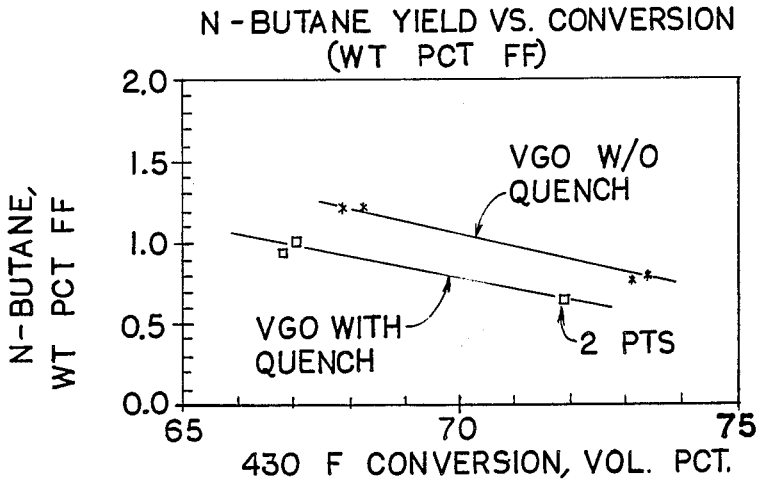
Figure 10:
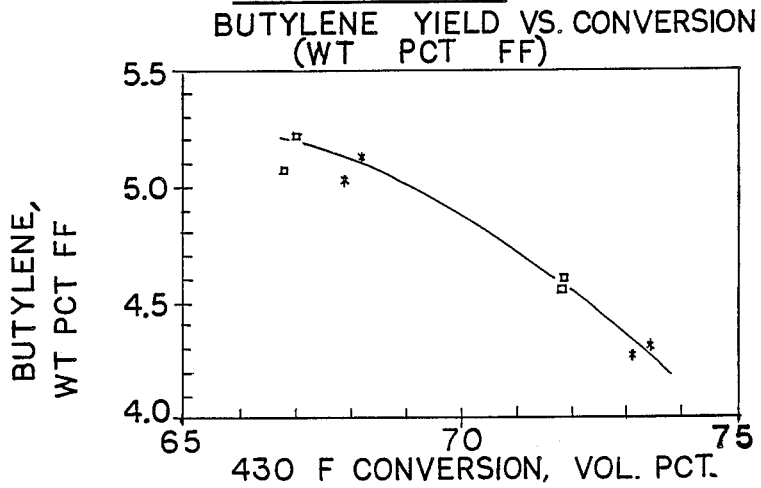
Figure 11:
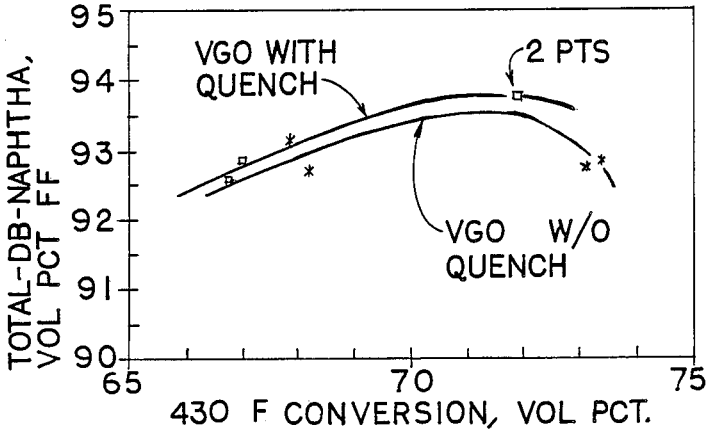
FIGS. 11–13 are graphs of the liquid yields: debutanized naphtha, light cycle gas oil and heavy cycle gas oil from cracked vacuum gas oil at different conversions.
Figure 12:
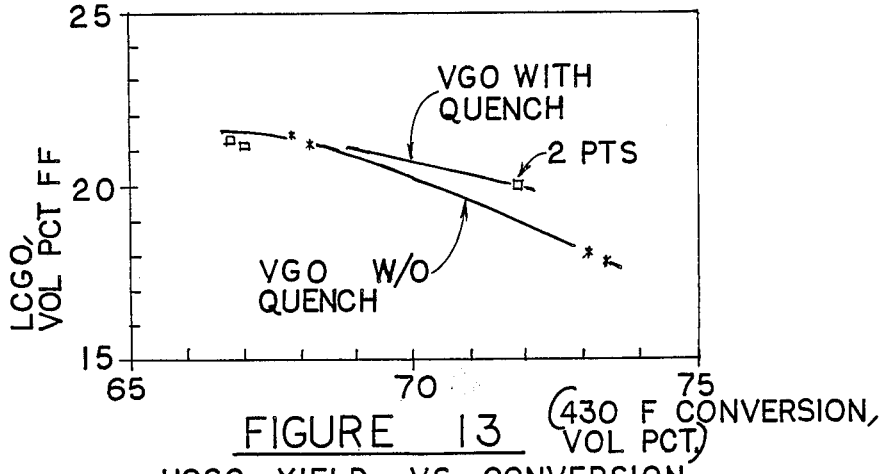
Figure 13:
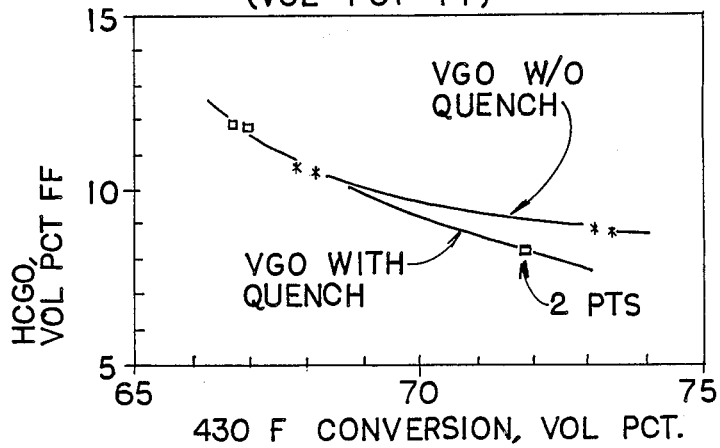
Figure 14:
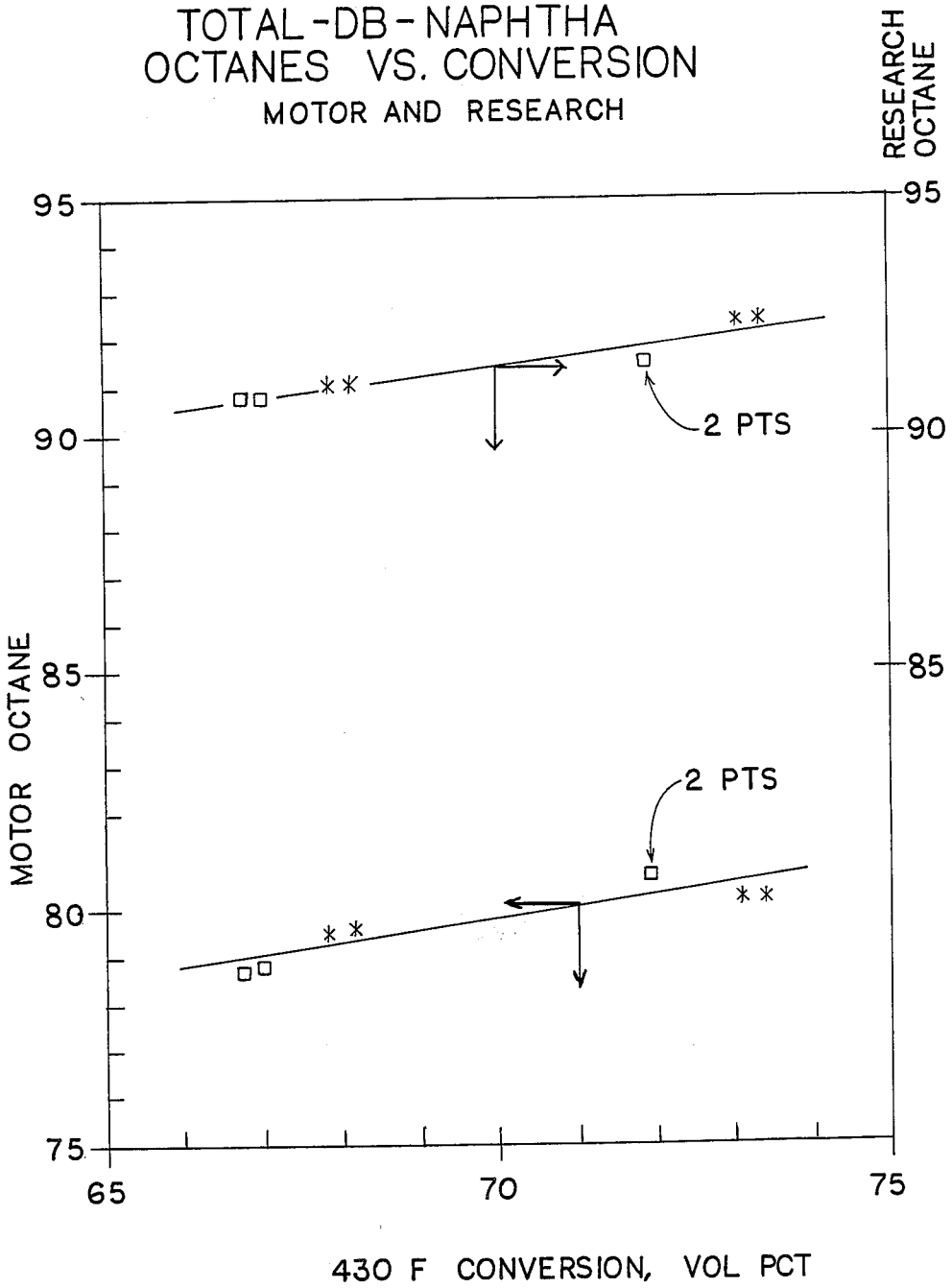
FIG. 14 is a graph of the quality of debutanized naphtha produced from cracked vacuum gas oil.

FIGS. 2-14 report the results from the series of experimental runs. FIG. 2 is a graphic representation of the temperature versus vol % of the riser, i.e. the riser temperature profile. This figure shows the riser outlet temperature is lowered by the injection of the water at the 90 vol % point compared to the usual relationship of riser temperature to vol % of the riser. FIG. 3 shows the relationship of riser outlet temperature to 430° F. conversion. FIG. 4 presents the 430° F. conversion related to the temperature at the 65 vol % control point of the riser. The 65 vol % point was held constant throughout runs 1-4 and throughout runs 5-8. FIG. 4 shows that when the riser temperature at the 65% point is held constant and water is added at the 90 vol % point a slight decrease in 430° F. conversion was observed. Lower yields of dry gas, propane, and n-butane were observed with almost no decrease in DB naphtha yield as the conversion was decreased. FIG. 5 is the dry gas yield versus 430° F. conversion and shows that when water is injected into the riser at the 90% point a small decrease of about 0.5 wt % in dry gas yield occurs compared to the run without water injection. FIGS. 6-10 report the $C_3$ and $C_4$ yields versus 430° F. conversion. We observed that at constant conversion, water injected at the 90 vol % point caused a decrease in propane and n-butane yields and an increase in propylene and iso-butane yields. The butylene yield was unchanged. FIG. 11 reports the total DB-naphtha yield versus 430° F. conversion and shows that the naphtha yield is slightly higher at constant conversion when water is injected at the 90 vol % point compared to the run without water injection. FIGS. 12 and 13 report the light cycle gas oil (LCGO) and heavy cycle gas oil (HCGO) yields versus 430° F. conversion. The LCGO-HCGO split is the same for runs with and without water injection at and below 68 vol % conversion. However as 430° F. conversion is increased above 68 vol %, water injection yields slightly more LCGO and less HCGO than without water injection. FIGS. 11 and 12 show that above 70 vol % conversion there is a significant increase in total DB naphtha plus LCGO yield with water quench compared to operation without water quench. FIG. 14 presents total DB-naphtha octane versus 430° F. conversion. The upper curve is research octane and the lower curve motor octane. There is no difference in octane at constant conversion with water quench versus operation without water quench. However water quench allows higher conversion which increases the DB naphtha octane without increasing the dry gas yield. For example, FIG. 5 shows essentially equal dry gas yields for 68% conversion without water quench and for 71% conversion with water quench. This increase in conversion corresponds to a 0.7 MON or RON increase in octane as shown in FIG. 14.

TABLE I

INSPECTION TESTS ON CATALYST*

| | EQUILIBRIUM | FRESH |
|---|---|---|
| METALS ON CATALYST | | |
| Cu wppm | 27 | 20 |
| Ni | 316 | 35 |
| Fe | 400 | 440 |
| V | 698 | 56 |
| Na (wt %) | 0.24 | 0.20 |
| ACTIVITY (MAT) | 67 | 75 |
| SURFACE AREA ($M^2$/gm) | 153 | 278 |
| DENSITY (lb/ft$^3$) | | |
| Compacted | 57.2 | 61.2 |
| Aerated | 52.0 | 49.9 |
| PORE VOLUME cc/gram | 0.36 | 0.40 |
| PARTICLE SIZE, wt % | | |
| 22 microns | 0.0 | 1.3 |
| 22–44 microns | 7.3 | 20 |
| 44–88 microns | 49.7 | 48.1 |
| 88+ microns | 43.0 | 30.6 |
| AVERAGE | 82.5 | 67.7 |

*Englehard HEZ-55

TABLE II

INSPECTION TESTS ON CHARGESTOCK

| Description | Alaskan North Slope VGO |
|---|---|
| Gravity, API | 23.3 |
| ASTM Distillation, F* | |
| 5/10/20 | 587/626/669 |
| 30/40/50 | 703/742/786 |
| 60/70/80 | 828/871 |
| Viscosity, cSt @ 100 C | 5.5 |
| 76.7 C | 10.03 |
| Pour Point, °F. | +45. |
| Sulfur, wt % | 1.13 |
| Total Nitrogen, wppm | 1415. |
| Basic Nitrogen, wppm | 344. |
| Aniline Pt, °F. | 169. |
| Watson Aromatics, wt % | 43.7 |
| Conradson Carbon Residue, wt % | 1.10 |
| $nC_5$ Insoluble, wt % | 0.42 |
| Metals, X-ray wppm | |
| Ni/V | 1./<1. |
| Fe/Cr | 1./0. |
| Sodium, wppm | <1. |

*ASTM D1160 at 10 mm Hg pressure corrected to 760 mm Hg pressure

TABLE III

RISER OUTLET QUENCHED BY WATER INJECTION

| RUN | 1 | 2 | 3 | 4 | 5 | 6 | 7 | 8 |
|---|---|---|---|---|---|---|---|---|
| FRESH FEED RATE L/HR | 32.01 | 32.45 | 31.89 | 31.94 | 31.92 | 31.49 | 32.37 | 31.98 |
| $H_2O$ INJECTED, #/HR | 0.00 | 0.00 | 4.16 | 4.16 | 0.00 | 0.00 | 4.16 | 4.16 |
| REGEN TEMP, °F. | 1314.00 | 1330.00 | 1313.00 | 1313.00 | 1312.00 | 1328.00 | 1324.00 | 1320.00 |
| FF PREHEAT, °F. | 561.00 | 561.00 | 560.00 | 558.00 | 553.00 | 553.00 | 552.00 | 552.00 |
| RISER BASE TEMP, °F. | 1169.00 | 1175.00 | 1170.00 | 1170.00 | 1209.00 | 1231,99 | 1260.00 | 1255.00 |
| RISER 20% PT. TEMP, °F. | 972.00 | 972.00 | 974.00 | 973.00 | 995.00 | 992.00 | 995.00 | 996.00 |
| RISER 45% PT. TEMP, °F. | 956.00 | 956.00 | 957.00 | 957.00 | 979.00 | 976.00 | 978.00 | 978.00 |
| RISER 65% PT. TEMP, °F. | 949.00 | 948.00 | 950.00 | 950.00 | 971.00 | 968.00 | 971.00 | 971.00 |
| RISER OUT TEMP, °F. | 949.00 | 948.00 | 906.00 | 910.00 | 971.00 | 968.00 | 941.00 | 939.00 |
| CONVERSION, VOL % FRESH FEED | 68.18 | 67.86 | 66.98 | 66.76 | 73.40 | 73.11 | 71.89 | 71.90 |
| YIELDS, BASIS FRESH FEED | | | | | | | | |
| $H_2S$, WT % | 0.51 | 0.53 | 0.60 | 0.59 | 0.61 | 0.63 | 0.65 | 0.62 |
| COKE, WT % | 4.49 | 4.16 | 4.48 | 4.86 | 5.40 | 5.24 | 5.16 | 5.15 |
| DRY GAS, $H_2$—$C_2$, WT % | 4.19 | 4.23 | 3.63 | 3.55 | 5.24 | 5.31 | 4.37 | 4.42 |
| PROPANE, WT % | 1.55 | 1.53 | 1.30 | 1.27 | 1.73 | 1.72 | 1.39 | 1.36 |
| PROPYLENE, WT % | 3.74 | 3.61 | 3.64 | 3.60 | 4.59 | 4.55 | 4.38 | 4.44 |
| ISOBUTANE, WT % | 2.40 | 2.24 | 2.44 | 2.37 | 3.11 | 2.93 | 2.93 | 2.93 |
| NORMAL BUTANE, WT % | 1.21 | 1.20 | 1.02 | 0.96 | 0.82 | 0.79 | 0.66 | 0.67 |
| BUTYLENE, WT % | 5.13 | 5.03 | 5.20 | 5.08 | 4.31 | 4.28 | 4.57 | 4.60 |
| TOTAL DB NAPHTHA, WT % | 43.22 | 43.58 | 43.14 | 42.95 | 43.20 | 43.19 | 43.90 | 43.88 |
| LCGO, WT % | 21.48 | 21.69 | 21.28 | 21.42 | 18.36 | 18.56 | 20.49 | 20.48 |
| HCGO, WT % | 12.09 | 12.21 | 13.27 | 13.36 | 10.45 | 10.56 | 9.74 | 9.74 |
| TOTAL DB NAPHTHA, VOL % | 52.72 | 53.11 | 52.82 | 52.52 | 52.85 | 52.76 | 53.78 | 53.76 |
| LCGO, VOL % | 21.24 | 21.46 | 21.21 | 21.35 | 17.82 | 18.02 | 19.93 | 19.92 |
| HCGO, VOL % | 10.58 | 10.68 | 11.81 | 11.89 | 8.78 | 8.87 | 8.18 | 8.18 |
| NAPHTHA GRAVITY, API | 57.30 | 57.10 | 58.00 | 57.80 | 57.90 | 57.60 | 58.10 | 58.20 |
| LCGO GRAVITY, API | 21.60 | 21.60 | 22.80 | 22.80 | 18.80 | 18.80 | 19.10 | 19.10 |
| HCGO GRAVITY, API | 3.90 | 3.90 | 6.30 | 6.30 | −1.50 | −1.50 | −1.50 | −1.50 |
| NAPHTHA RESEARCH OCT | 91.10 | 91.10 | 90.80 | 90.80 | 92.40 | 92.40 | 91.50 | 91.50 |
| NAPHTHA MOTOR OCTANE | 79.60 | 79.50 | 78.80 | 78.70 | 80.20 | 80.20 | 80.70 | 80.70 |
| NAPHTHA OCTANE BBLS* | 45.00 | 45.30 | 44.79 | 44.51 | 45.61 | 45.53 | 46.30 | 46.29 |

*CALCULATED ((R + M)/2)* TOTAL DB NAPHTHA, VOL %

While particular embodiments of the invention have been described, it will be understood that the invention is not limited thereto since modifications may be made and it is therefore contemplated to cover by the appended claims any such modifications as all within the spirit and scope of the claims.

What is claimed is:

1. In a fluid catalytic cracking process wherein said process takes placed in an apparatus comprising a riser cracking zone at a first temperature for maximum conversion of a vacuum gas oil to debutanized naphtha, a catalyst separation zone and a catalyst regeneration zone, wherein the improvement comprises:

a. contacting said vacuum gas oil with a regenerated fluidized cracking catalyst to form a first suspension in an initial portion of said riser cracking zone for a contacting time of about 1.5 to 5.0 seconds at a second temperature at least 5° F. above said first temperature;

b. quenching the first suspension in a downstream portion of the riser cracking zone with a refractory fluid prior to said suspension entering said separation zone, said refractory fluid selected from the group consisting of liquid water and steam, to form a second suspension at a third temperature at least 10° F. below said first temperature for a contacting time of about 0.5 seconds or less;

c. separating cracking catalyst with deposited contaminants of hydrocarbon cracking from hydrocarbon cracking products of said vacuum gas oil in said catalyst separation zone;

d. regenerating separated cracking catalyst with deposited contaminants of hydrocarbon cracking in said catalyst regeneration zone wherein said catalyst is raised to a temperature of about 1100° to 1400° F. to yield a regenerated cracking catalyst wherein deposited contaminants are reduced to about 0.1 wt % or less.

2. The process of claim 1 wherein said second temperature is about 5° F. to 15° F. above said first temperature.

3. The process of claim 1 wherein said second temperature is about 5° F. to 15° F. above said first temperature and said third temperature is at least 15° F. lower than said first temperature.

4. The process of claim 1 wherein said second temperature is about 920° to 1050° F. and said third temperature is at least 15° F. lower than said first temperature.

5. The process of claim 1 wherein said second temperature is about 950° F. to 1000° F. and said third temperature is at least 15° F. lower than said first temperature.

6. The process of claim 1 wherein the downstream portion of the riser conversion zone is the last 5 to 15 vol % of the riser cracking zone.

7. The process of claim 1 wherein the downstream portion of the riser conversion zone is about the last 10 vol % of the riser cracking zone.

8. The process of claim 1 wherein the refractory fluid is steam.

9. The process of claim 1 wherein the refractory fluid is liquid water.

10. The process of claim 1 wherein the amount of refractory fluid is 1 to 20 wt % of the amount of vacuum gas oil.

11. The process of claim 1 wherein the refractory fluid is liquid water in an amount of 3 to 7 wt % of the amount of vacuum gas oil and the catalyst to oil weight ratio is 4 to 5.

* * * * *